US008639170B2

(12) United States Patent
Yonekawa et al.

(10) Patent No.: US 8,639,170 B2
(45) Date of Patent: Jan. 28, 2014

(54) FIXING DEVICE AND IMAGE FORMING APPARATUS WITH A MECHANISM TO EXTEND LIFE OF A FIXING BELT

(75) Inventors: Noboru Yonekawa, Toyohashi (JP); Mamoru Fukaya, Nagoya (JP); Naoki Yamamoto, Toyohashi (JP); Toru Hayase, Toyohashi (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 218 days.

(21) Appl. No.: 13/112,325

(22) Filed: May 20, 2011

(65) Prior Publication Data

US 2011/0299901 A1 Dec. 8, 2011

(30) Foreign Application Priority Data

Jun. 3, 2010 (JP) ..... 2010-127576

(51) Int. Cl.
*G03G 15/20* (2006.01)

(52) U.S. Cl.
USPC ..... 399/329; 399/333

(58) Field of Classification Search
USPC ..... 399/329, 333
See application file for complete search history.

(56) References Cited

U.S. PATENT DOCUMENTS

| | | | | |
|---|---|---|---|---|
| 5,257,078 | A | 10/1993 | Kuroda | |
| 5,483,331 | A | 1/1996 | Wayman et al. | |
| 5,541,719 | A * | 7/1996 | Tamaki | |
| 5,722,025 | A | 2/1998 | Morigami et al. | |
| 7,024,146 | B2 * | 4/2006 | Kim et al. | 399/333 |
| 8,165,485 | B2 * | 4/2012 | Asakura et al. | 399/329 |
| 8,346,148 | B2 | 1/2013 | Yonekawa et al. | |
| 2009/0169231 | A1 * | 7/2009 | Asakura et al. | 399/329 |
| 2011/0026990 | A1 | 2/2011 | Arimoto | |
| 2011/0299902 | A1 | 12/2011 | Yonekawa et al. | |
| 2012/0063824 | A1 * | 3/2012 | Schmitt et al. | 399/329 |

FOREIGN PATENT DOCUMENTS

| | | |
|---|---|---|
| CN | 101470392 | 7/2009 |
| JP | 59-155874 | 9/1984 |
| JP | 64-979 | 1/1989 |
| JP | 5-500435 | 1/1993 |
| JP | 6-83224 | 3/1994 |

(Continued)

OTHER PUBLICATIONS

Notification of Reasons for Refusal mailed Mar. 27, 2012, directed to Japanese Application No. 2010-127574; 4 pages.

(Continued)

*Primary Examiner* — Susan Lee
(74) *Attorney, Agent, or Firm* — Morrison & Foerster LLP

(57) ABSTRACT

A fixing device for thermally fixing an unfixed image formed on a recording sheet by passing the recording sheet through a fixing nip. The fixing device has: a heat-generating endless belt having, on a circumferential surface thereof, a sheet passing area through which the recording sheet passes; a first pressure member disposed inside a running path of the endless belt; and a second pressure member disposed to press the endless belt against the first pressure member from outside the running path to form the fixing nip. The endless belt includes: a resistive heat layer that generates heat upon receiving electric current; and a pair of electrode layers that receive electric current. The electrode layers flank the sheet passing area. The resistive heat layer is in contact with the electrode layers at a different one of end faces opposing each other in a width direction of the resistive heat layer.

12 Claims, 12 Drawing Sheets

(56) References Cited

FOREIGN PATENT DOCUMENTS

| | | | |
|---|---|---|---|
| JP | 7-72752 | | 3/1995 |
| JP | 7-244441 | | 9/1995 |
| JP | 7-281549 | | 10/1995 |
| JP | 8-335000 | | 12/1996 |
| JP | 9-96982 | | 4/1997 |
| JP | 9-114295 | | 5/1997 |
| JP | 9-146400 | | 6/1997 |
| JP | 9-305050 | | 11/1997 |
| JP | 11-143286 | | 5/1999 |
| JP | 2001-155844 | | 6/2001 |
| JP | 2006-49088 | | 2/2006 |
| JP | 2007-134083 | | 5/2007 |
| JP | 2007-272223 | | 10/2007 |
| JP | 2008-268354 | | 11/2008 |
| JP | 2009092785 A | * | 4/2009 |
| JP | 2009-109997 | | 5/2009 |
| JP | 2009-157108 | | 7/2009 |
| JP | 2009-251132 | | 10/2009 |
| WO | WO-91/10336 | | 7/1991 |

OTHER PUBLICATIONS

Decision to Grant a Patent mailed Apr. 17, 2012, directed to Japanese Application No. 2010-127575; 5 pages.

Yonekawa et al., Notice of Allowance mailed Sep. 4, 2012, directed to U.S. Appl. No. 13/111,093; 8 pages.

Notification of Reasons for Refusal mailed Mar. 27, 2012, directed to Japanese Application No. 2010-127576; 7 pages.

Yonekawa et al., U.S. Office Action mailed Jun. 12, 2013, directed to U.S. Appl. No. 13/112,344; 6 pages.

The First Office Action mailed Jul. 19, 2013, directed to Chinese Patent Application No. 20110148610.2; 17 pages.

The First Office Action mailed Jul. 19, 2013, directed to Chinese Patent Application No. 201110148714.3; 16 pages.

* cited by examiner

FIXING DEVICE AND IMAGE FORMING APPARATUS WITH A MECHANISM TO EXTEND LIFE OF A FIXING BELT

This application is based on an application No. 2010-127576 filed in Japan, the contents of which are hereby incorporated by reference.

BACKGROUND OF THE INVENTION (1) Field of the Invention

The present invention relates to a fixing device and an image forming apparatus including the fixing device. In particular, the present invention relates to a technology applicable to a fixing device to extend the life of a fixing belt that is included in the fixing device and that has a resistive heat layer and electrode layers for feeding power to the resistive heat layer.

(2) Description of the Related Art

As disclosed, for example, in JP patent application publication No. 2007-272223, some conventional image forming apparatuses (such as printers) employ a fixing device that generates heat upon receiving electric current directly applied to a fixing belt that includes a resistive heat layer.

Such a fixing device provides an advantage of energy savings over a fixing device employing a halogen heater as a heat source.

FIG. 14 is a sectional view of a fixing belt included in a fixing device having a resistive heat layer.

As shown in the figure, a fixing belt 500 includes a reinforcing layer 555 and a resistive heat layer 556 laminated on the reinforcing layer 555.

On the outer circumferential surface of the resistive heat layer 556, a pair of electrode layers 559 are disposed each along an edge of the resistive heat layer 556. The electrode layers 559 are made of metal material and act as electrodes for receiving power from an external power supply.

On the outer circumferential surface of the resistive heat layer 556, in addition, a releasing layer 557 is disposed between the pair of electrode layers 559 for helping a recording sheet to be smoothly released.

Note that the resistive heat layer 556 is made of a material having high electrical resistance and therefore generates heat due to Joule heating in response to the passage of electric current.

With the above configuration, by placing the electrode layers 559 into contact with a pair of power feeders 570 connected to an external AC power source 580, a potential difference is produced across the edges of the resistive heat layer 556 to cause an electric current to pass through the resistive heat layer 556.

As a result, the resistive heat layer 556 generates heat, which is used for thermally fusing an image onto a recording sheet.

Unfortunately, the fixing belt 500 having the above configuration has been found to cause local overheating as a result of the passage of electric current for a long period of time. The overheating occurs locally at around contact portions 560 where the edge of each electrode layer 559 closer toward the releasing layer 557 contacts the resistive heat layer 556.

Such local overheating accelerates deterioration of the heated portions as compared with other portions, which ends up reducing the life of the fixing belt 500.

The following are believed to be the causes of the local overheating.

That is, due to the tendency to flow into where the resistance is lower, the electric current fed to each electrode layer 559 from a corresponding one of the power feeders 570 flows into the resistive heat layer 556 through a portion closer to the other electrode layer 559.

As a result, the electric current flowing between each electrode layer 559 and the resistive heat layer 556 concentrates mainly at the contact portions 560 where the edge of each electrode layer 559 closer toward the releasing layer 557 contacts the resistive heat layer 556.

The electric current flowing into the resistive heat layer 556 locally through each contact portion 560 is then distributed in the thickness direction of the resistive heat layer 556 and concentrates again at around the other contact portion 560.

As a result, the current density reaches the maximum at the contact portions 560, which results in overheating at the corresponding portions of the resistive heat layer 556.

SUMMARY OF THE INVENTION

The present invention is made in view of the above problems and aims to extend the life of a fixing belt included in a fixing device and in an image forming apparatus using a resistance heat generation mechanism.

In order to achieve the above aim, a first aspect of the present invention provides a fixing device a fixing device for thermally fixing an unfixed image formed on a recording sheet by passing the recording sheet through a fixing nip. The fixing device has: a heat-generating endless belt having, on a circumferential surface thereof, a sheet passing area through which the recording sheet passes; a first pressure member disposed inside a running path of the heat-generating endless belt; and a second pressure member disposed to press the heat-generating endless belt against the first pressure member from outside the running path to form the fixing nip. The heat-generating endless belt includes: a resistive heat layer that generates heat upon having electric current applied thereto; and a pair of electrode layers that receive electric current, the electrode layers flanking the sheet passing area. The resistive heat layer is in contact with the electrode layers at a different one of end faces opposing each other in a width direction of the resistive heat layer.

In order to achieve the above aim, a second aspect of the present invention provides an image forming apparatus including a fixing device for thermally fixing an unfixed image formed on a recording sheet by passing the recording sheet through a fixing nip. The fixing device has: a heat-generating endless belt having, on a circumferential surface thereof, a sheet passing area through which the recording sheet passes; a first pressure member disposed inside a running path of the heat-generating endless belt; and a second pressure member disposed to press the heat-generating endless belt against the first pressure member from outside the running path to form the fixing nip. The heat-generating endless belt includes: a resistive heat layer that generates heat upon having electric current applied thereto; and a pair of electrode layers that receive electric current, the electrode layers flanking the sheet passing area. The resistive heat layer is in contact with the electrode layers at a different one of end faces opposing each other in a width direction of the resistive heat layer.

BRIEF DESCRIPTION OF TILE DRAWINGS

These and the other objects, advantages and features of the invention will become apparent from the following description thereof taken in conjunction with the accompanying drawings which illustrate a specific embodiment of the invention. In the drawings.

Figure 8:
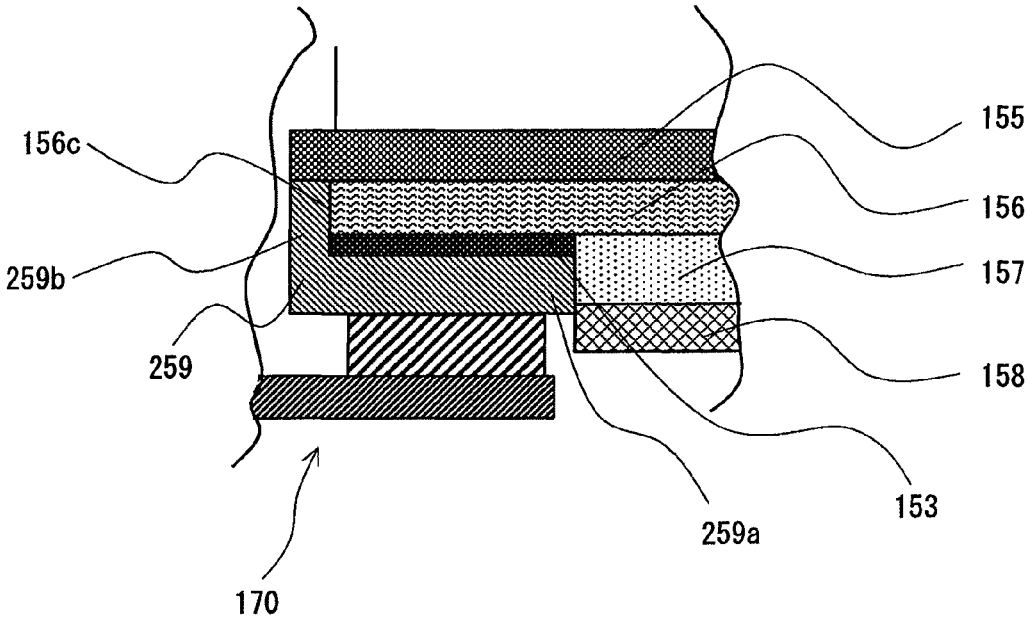
Figure 8:
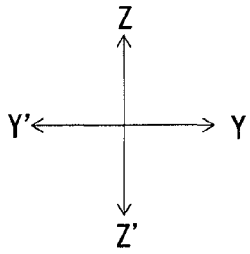
Figure 9:
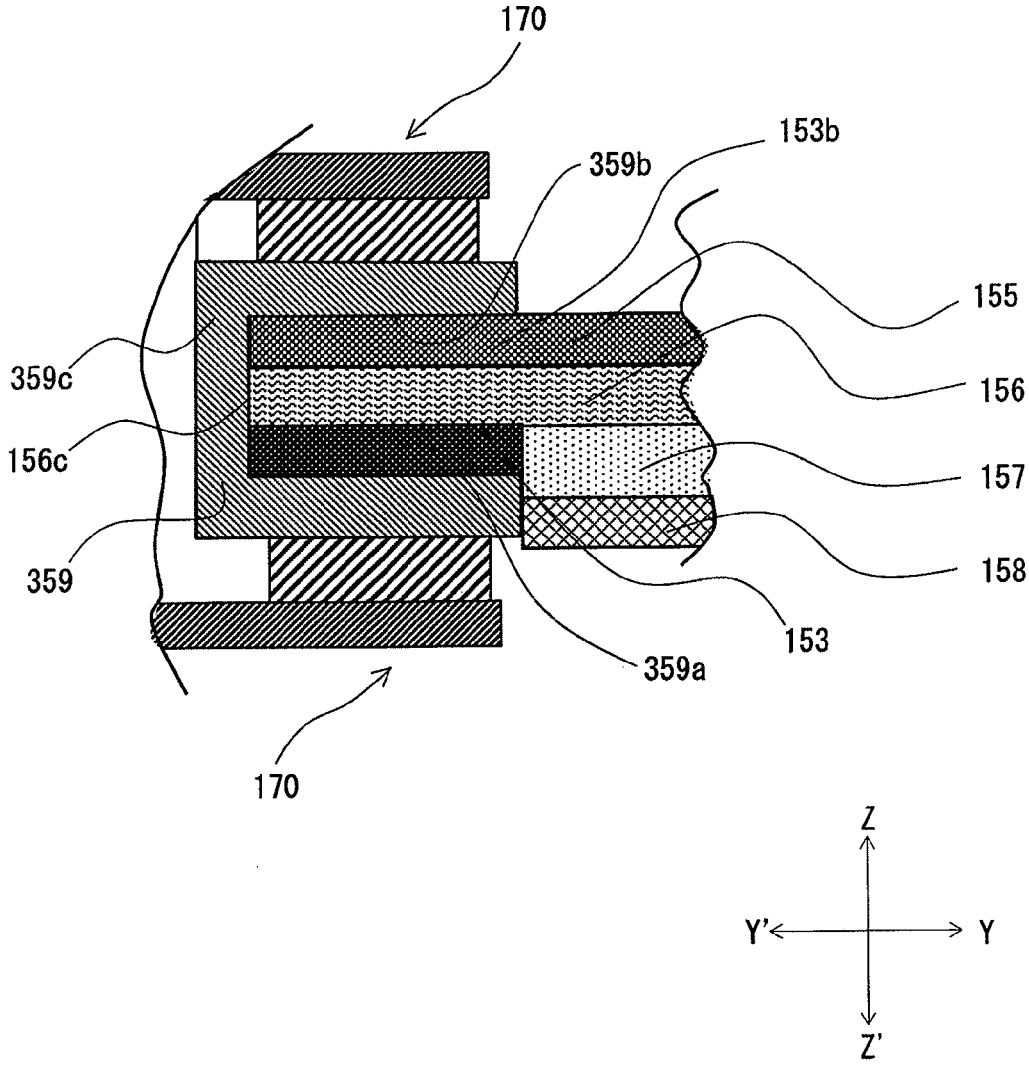
Figure 10:
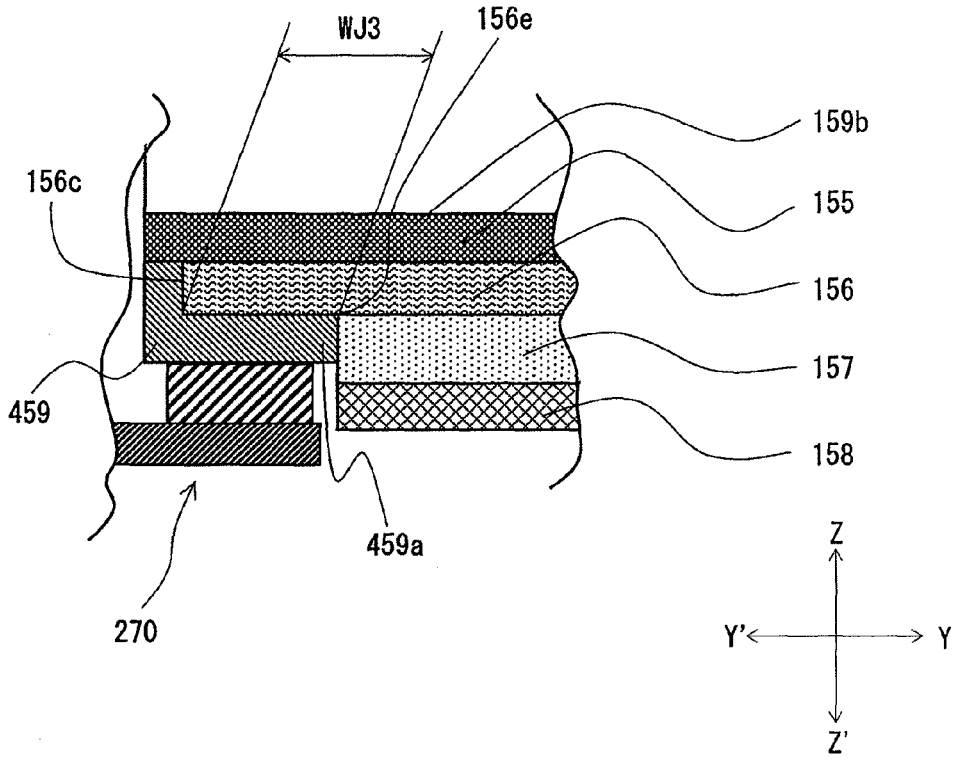
Figure 11:
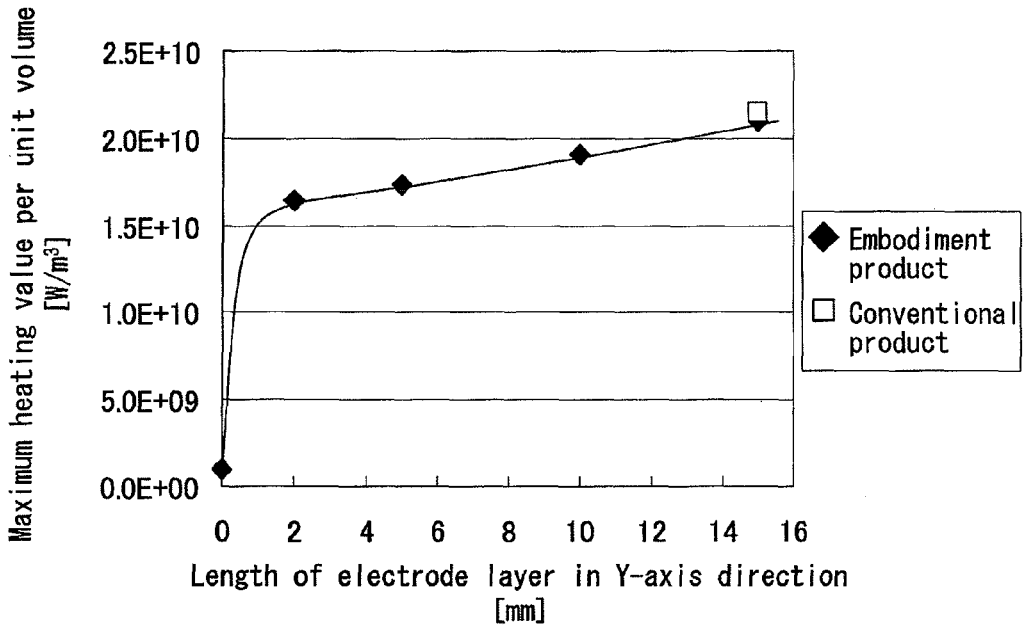
Figure 12:
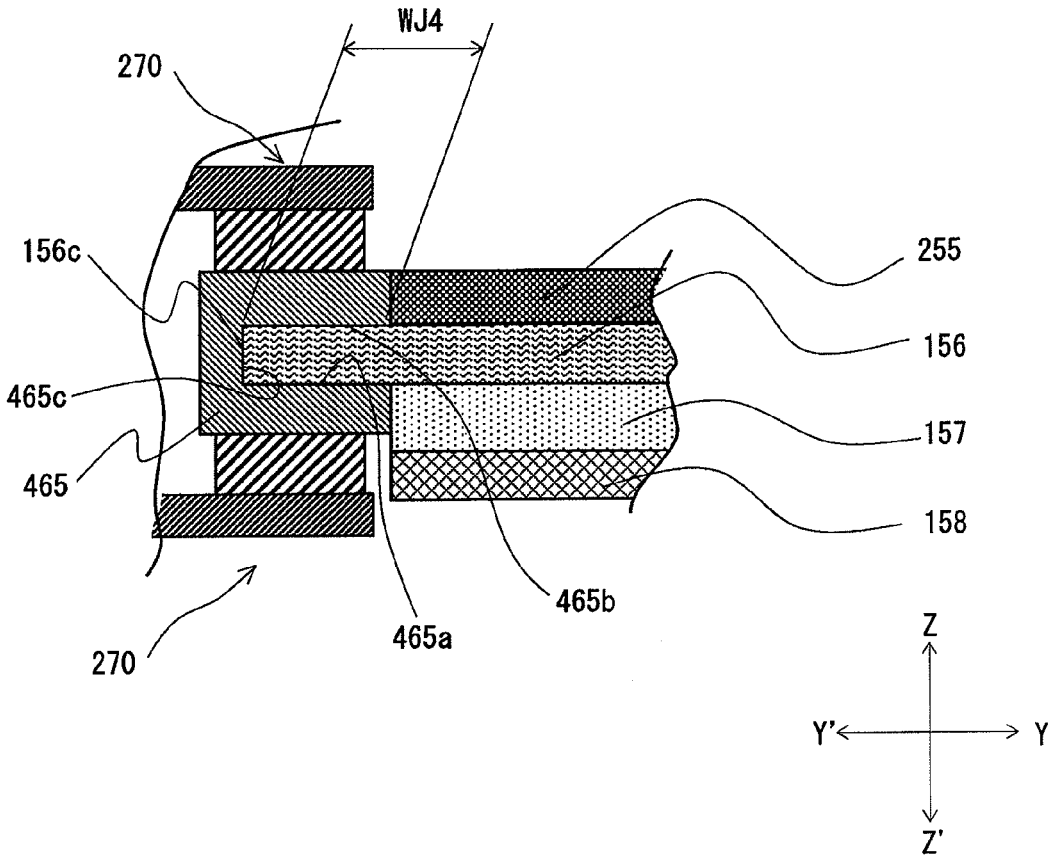
Figure 13:
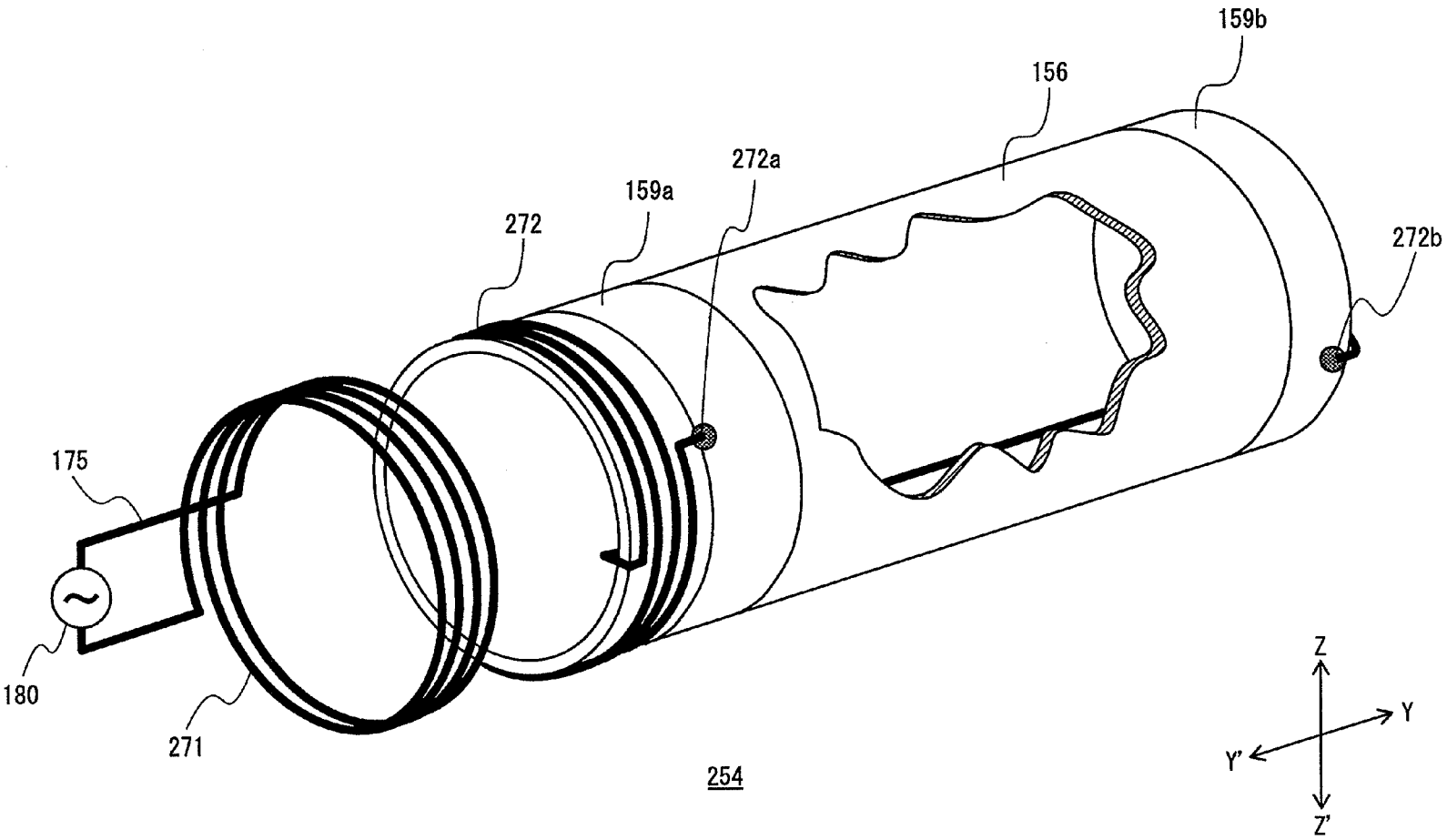
Figure 14:
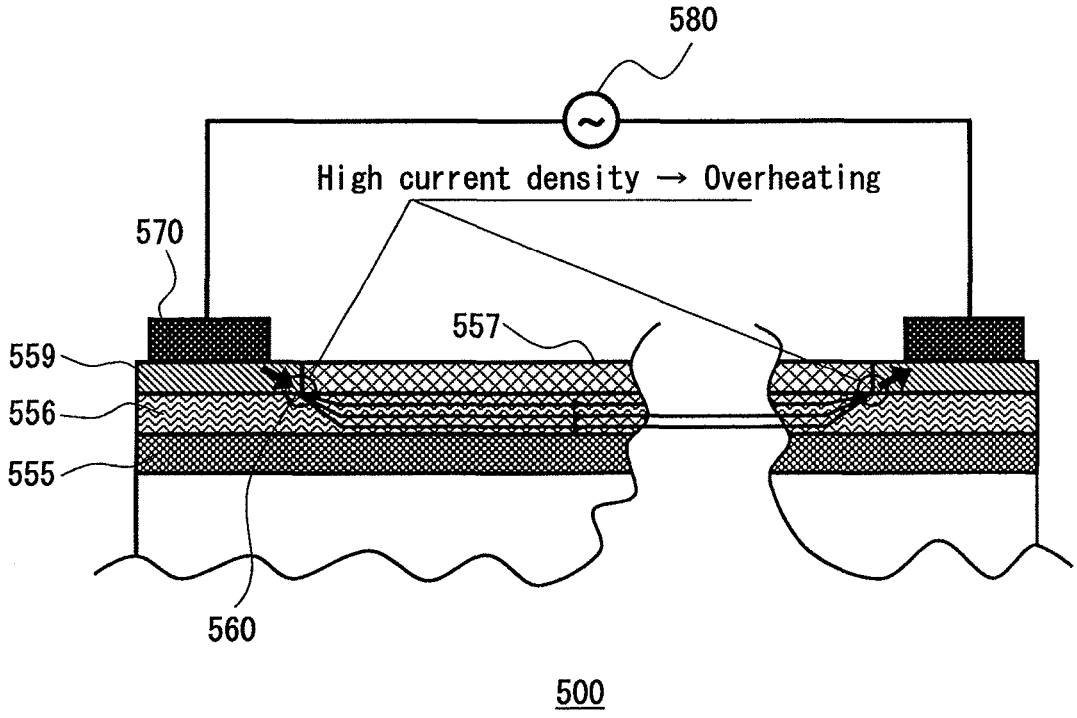
FIG. 14 Prior Art

FIG. 8 is a view of a fixing device according to a modification 1 of the present invention; and FIG. 9 is a view of a fixing device according to a modification 2 of the present invention; and FIG. 10 is a view of a fixing device according to a modification 3 of the present invention; and FIG. 11 is a graph of simulated temperatures of overheating portions of the fixing device according to the modification 3 of the present invention;

FIG. 12 is a view of a fixing device according to a modification 4 of the present invention; and FIG. 13 is a view of a fixing device according to a modification 5 of the present invention; and FIG. 14 is a sectional view of a conventional fixing belt.

DESCRIPTION OF THE PREFERRED EMBODIMENTS

The following describes an embodiment in which an image forming apparatus of the present invention is applied to a tandem-type digital color printer (hereinafter, simply "printer").

Figure 1:
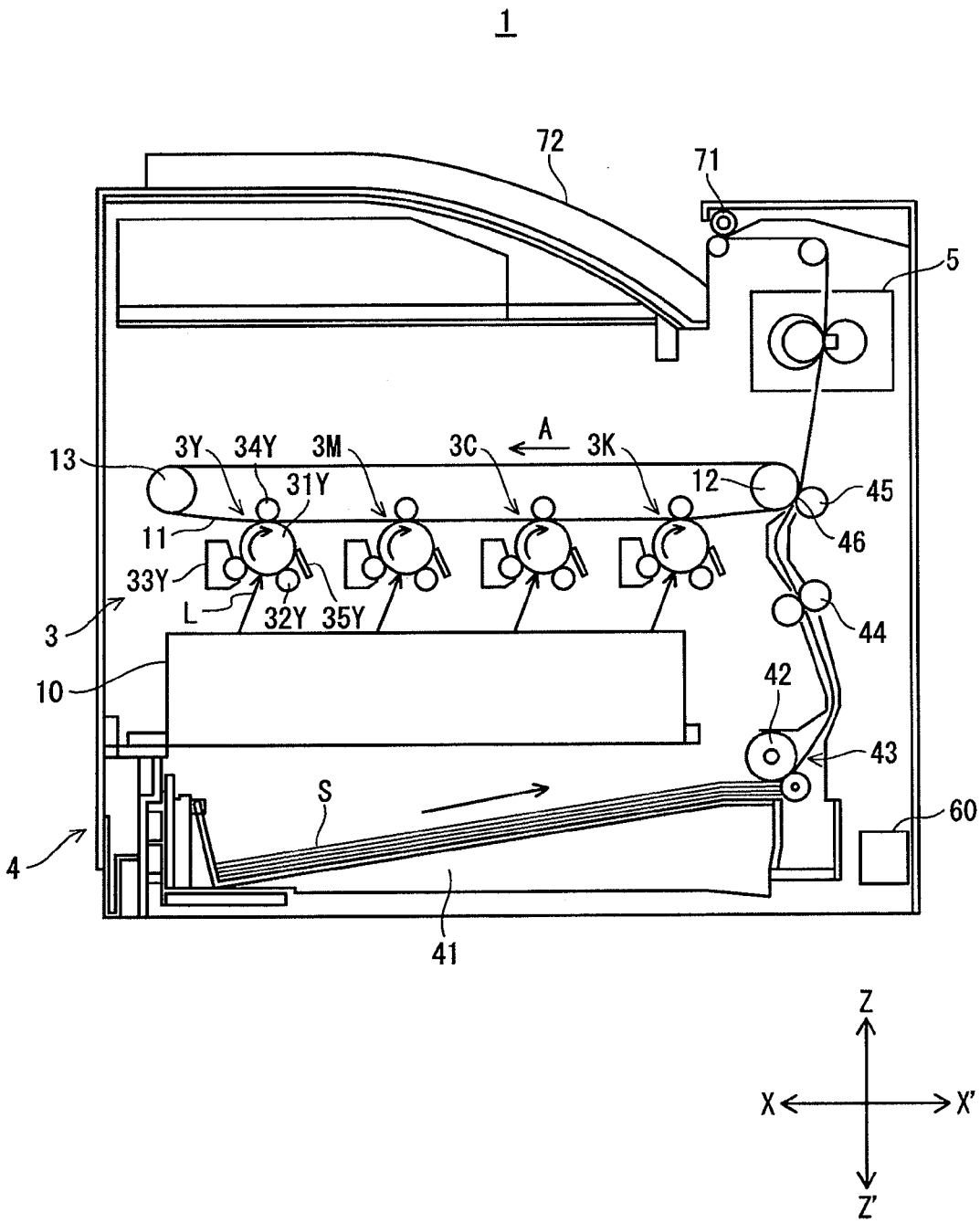
FIG. 1 is a schematic cross-sectional view showing the entire structure of a printer according to an embodiment of the present invention.

FIG. 1 is a schematic cross-sectional view showing the entire structure of a printer 1 according to the embodiment.

As shown in FIG. 1, the printer 1 includes an image processer 3, a sheet feeder 4, a fixing unit 5, and a controller 60. The printer 1 may be connected to a network (such as LAN) to receive instructions for executing a print job from an external terminal device (not shown). Upon receipt of such an instruction, the printer 1 forms toner images of the respective colors of yellow, magenta, cyan, and black, and sequentially transfers the toner images to form a full-color image.

In the following description, the reproduction colors of yellow, magenta, cyan, and black are denoted as "Y", "M", "C" and "K", respectively, and any structural component related to one of the reproduction colors is denoted by a reference sign attached with an appropriate subscript "Y", "M", "C" or "K".

<Image Processer>

The image processer 3 includes image creating units 3Y, 3M, 3C, and 3K respectively corresponding to the colors Y, M, C, and K, and also includes an optical unit 10 and an intermediate transfer belt 11.

The image creating unit 3Y includes a photoconductive drum 31Y and also includes a charger 32Y, a developer 33Y, a first transfer roller 34Y, and a cleaner 35Y, which are disposed about the photoconductive drum 31Y. The cleaner 35Y is provided for cleaning the photoconductive drum 31Y. The image creating unit 3Y forms a yellow toner image on the photoconductive drum 31Y. The other image creating units 3M through 3K have the same configuration as the image creating unit 3Y, and thus reference signs for components of these units are omitted in FIG. 1.

The intermediate transfer belt 11 is an endless belt wound around a drive roller 12 and a passive roller 13 in taut condition to rotatably run in the direction indicated by the arrow "A".

The optical unit 10 includes a light emitting element, such as a laser diode. In accordance with drive signals from the controller 60, the optical unit 10 emits a laser beam L to sequentially scan the surfaces of the photoconductive drums 31Y-31K to form images of the respective colors Y, M, C, and K.

By the laser scanning, electrostatic latent images are formed on the photoconductive drums 31Y-31K which have been charged by the chargers 32Y-32K, respectively. Then, the electrostatic latent images are sequentially developed by the respective developers 33Y-33K to form toner images of colors Y-K on the photoconductive drum 31Y-31K with appropriately adjusted timing. As a result, the process of first transfer is carried out to layer the transferred images on precisely the same position on the surface of the intermediate transfer belt 11.

By the action of the electrostatic force imposed by the first transfer rollers 34Y-34K, the toner images of the respective colors are sequentially transferred onto the intermediate transfer belt 11 to form a full color toner image, which is then carried to a second transfer position 46 by the intermediate transfer belt 11.

The sheet feeder 4 includes: a paper feed cassette 41 for storing recording sheets S; a pickup roller 42 that picks up a recording sheet S from the paper feed cassette 41 one sheet at a time and feeds the recording sheet S onto a transport path 43; and a pair of timing rollers 44 that adjusts the timing to transport the fed recording sheet S to a second transfer position 46. In a timed relation to the transport of the toner images carried on the intermediate transfer belt 11, the sheet feeder 4 feeds the recording sheet S to the second transfer position 46 where the tonner images of the respective colors on the intermediate transfer belt 11 are collectively transferred onto the recording sheet S by the action of a second transfer roller 45.

The recording sheet S having passed through the second transfer position 46 is transported to the fixing unit 5 where heat and pressure is applied to the recording sheet S, so that the tonner image (unfixed image) on the recording sheet S is fused and fixed. The recording sheet S then passes between a pair of ejection rollers 71 to be ejected onto an exit tray 72.

<Fixing Unit>

Figure 2:
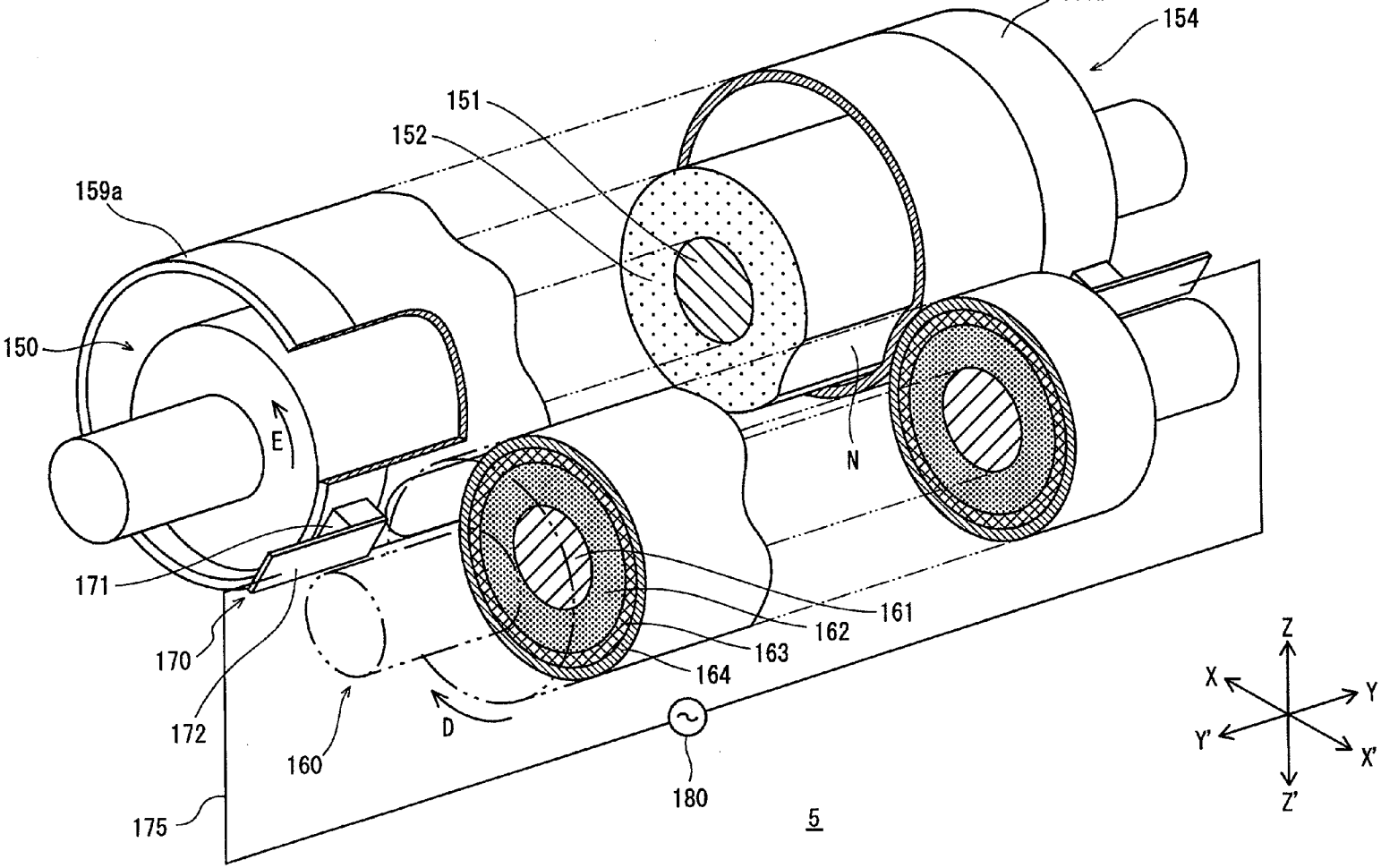
FIG. 2 is a partially broken perspective view of a fixing device according to the embodiment of the present invention.
Figure 3:
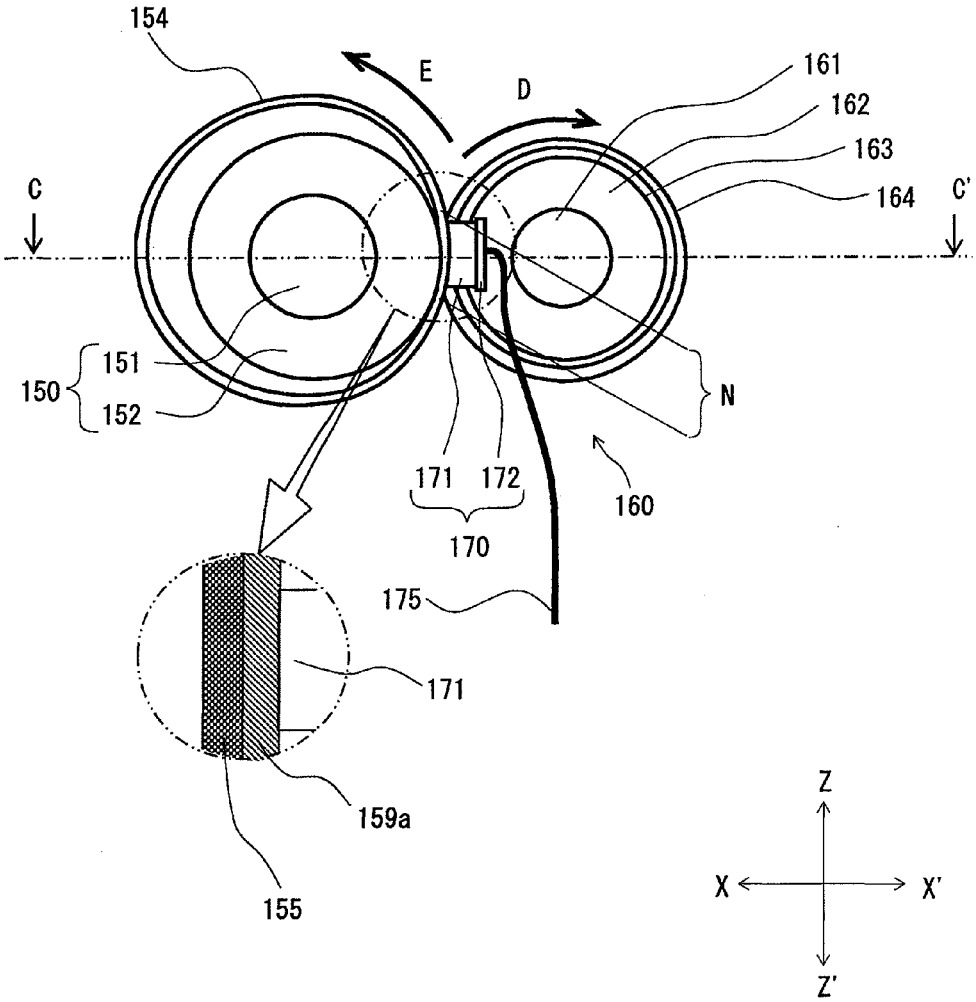
FIG. 3 is a side view of the fixing device according to the embodiment of the present invention.

FIG. 2 is a partially broken, perspective view of the fixing unit 5, whereas FIG. 3 is a side view of the fixing unit 5.

As shown in FIG. 2, the fixing unit 5 includes a fixing belt 154, a pressure roller 150, a pressing roller 160, and a pair of power feeders 170.

The pressure roller 150 is disposed inside the running path of the fixing belt 154 with play (i.e., clearance) relatively to the fixing belt 154.

On the other hand, the pressing roller 160 is disposed outside the running path of the fixing belt 154 and driven by a driving mechanism (not shown) to run in the direction indicated by the arrow D, while pressurizing the pressure roller 150 from outside via the fixing belt 154.

This causes the fixing belt 154 and the pressure roller 150 to rotate passively in the direction indicated by the arrow E, thereby forming a fixing nip N between the pressure roller 150 and the fixing belt 154.

When the recording sheet (not shown) passes through the fixing nip N while the fixing nip N is maintained at a target temperature, heat and pressure is applied to the recording sheet to fuse the unfixed toner image formed on the recording sheet.

The following describes in detail the structure of the fixing unit 5.

<Pressure Roller>

The pressure roller 150 is composed of a cylindrical roller shaft 151 of long dimension and an elastic layer 152 covering the circumferential surface of the roller shaft 151.

The roller shaft 151 is made of, for example, aluminum, iron, or stainless and in the shape of a cylinder that measures approximately 18 mm in outer diameter. The roller shaft 151 is rotatably supported with its axial ends received in bearings that are provided on the main frame (not shown) of the fixing unit 5.

The elastic layer 152 is made of a highly heat-resistant and heat-insulating foamed elastic material, such as a silicone rubber or a fluorine-containing rubber. The thickness of the elastic layer 152 is in the range from 1 mm to 20 mm. Thus the outer diameter of the pressure roller 150 falls in the range from 20 mm to 100 mm. In the present example, the outer diameter of the pressure roller 150 is 5 mm.

The elastic layer 152 is 350 mm long in the Y-axis direction.

<Pressing Roller>

The pressing roller 160 includes a roller shaft 161 and also includes an elastic layer 162, an adhesive layer 163, and a releasing layer 164 that are laminated on the outer circumferential surface of the roller shaft 161 in the stated order.

The roller shaft 161 is, for example, a solid aluminum shaft having an outer diameter of approximately 30 mm and rotated by a driving mechanism (not shown).

The elastic layer 162 is a tubular-shaped silicone rubber which measures 310 mm in the Y-axis direction.

Alternatively to the silicone rubber, the elastic layer 162 may be made of a highly heat-resistant material, such as a fluorine-containing rubber.

The thickness of the elastic layer 162 is preferably in the range from 1 mm to 20 mm, and is 2 mm in the present example.

The releasing layer 164 is formed from a fluorine-containing resin such as polytetrafluoroethylene (PTFE) or tetrafluoroethylene perfluoroalkoxy vinyl ether copolymer (PFA) to have a thickness in the range from 10 μm to 50 μm.

The adhesive layer 163 is made by, for example, applying an adhesive, such as a silicone adhesive, to the surface of the elastic layer 162.

Note that the elastic layer 162, the adhesive layer 163, and the releasing layer 164 are all 310 mm long in the Y-axis direction, which is of course longer than the maximum paper width of any usable recording sheet.

<Power Feeders>

The power feeders 170 are electrically connected to an external power supply 180 via lead wires 175, and disposed in contact with a pair of electrode layers 159*a* and 159*b* (which will be described later) of the fixing belt 154 to feed power to the electrode layers 159*a* and 159*b*.

The power supply 180 is, for example, a 100 V/50 or 60 Hz commercial power supply.

A relay switch (not shown) is provided in an inserted condition in the lead wires 175. The relay switch goes ON and OFF in accordance with instructions from the controller 60 to allow the electric current to pass through as necessary.

More specifically, each power feeder 170 is composed of a brush 171 and a leaf spring 172.

The brush 171 is a so-called carbon brush, which is made of a lubricating and conductive material, such as copper-graphite or carbon-graphite and has the shape of a rectangular solid that measures, for example, 12 mm in the Y-axis direction, 10 mm in the direction perpendicular to the Y-axis direction, and 15 mm in thickness.

The leaf spring 172 is a rectangular plate made of a conductive and resilient material, such as phosphor bronze or stainless. The leaf spring 172 is fixed at one end to an insulator on the main frame (not shown) of the printer 1, and is bonded at the other end to the brush 171 by, for example, an adhesive having electrical conductivity.

As shown in FIG. 3, the leaf spring 172 constitutes a path to feed power to the brush 171, and presses the brush 171 against the circumferential surface of the corresponding one of the electrode layers 159*a* and 159*b* (which will be described later) of the fixing belt 154.

<Fixing Belt>

Figure 4:
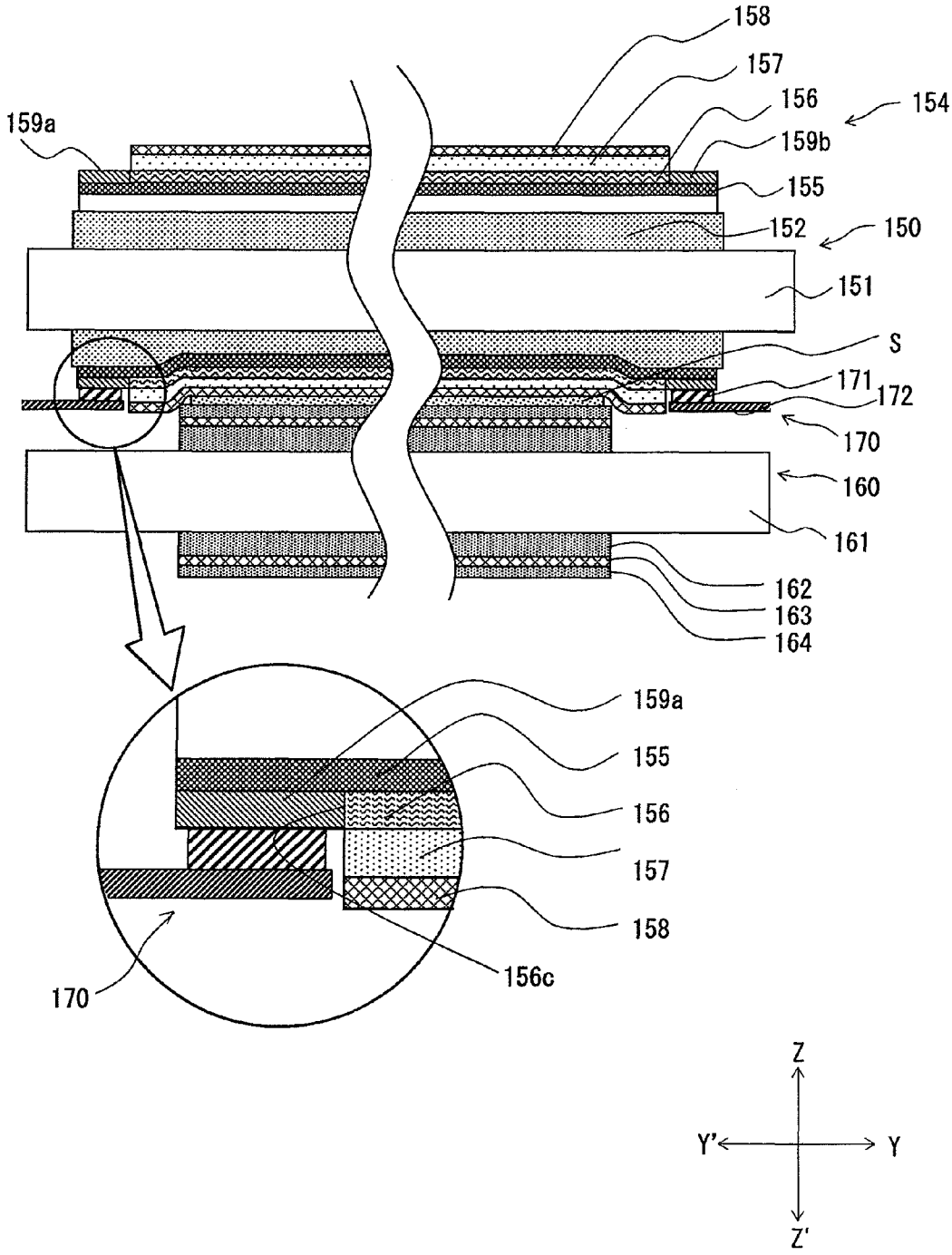
FIG. 4 is an axial sectional view of the fixing device according to the embodiment of the present invention.

FIG. 4 is a sectional view of the fixing device according to the present embodiment.

The fixing belt 154 is an elastically deformable endless belt having edge portions disposed to flank a middle portion (i.e., the portion other than the edge portions) in the Y-axis direction and the laminated state of the central portion is different from the edge portions.

The fixing belt 154 includes a reinforcing layer 155 that extends across the entire width of the fixing belt 154. One edge portion of the reinforcing layer 155 sits on the electrode layer 159*a*, whereas the other edge portion sits on the electrode layer 159*b*.

In addition, on part of the outer circumferential surface of the reinforcing layer 155 between the electrode layers 159*a* and 159*b*, a resistive heat layer 156, an elastic layer 157, and a releasing layer 158 are laminated in the stated order.

The following describes the configuration of the respective layers of the fixing belt 154 in detail.

The reinforcing layer 155 is made of a non-conductive material, such as polyimide (PI), polyphenylenesulfide (PPS) resin, or polyether ether ketone (PEEK), and its thickness is preferably in the range from 5 μm to 200 μm, and in the present example, it is set to 70 μm.

By applying potential difference across the edges of the resistive heat layer 156 in the Y-axis direction, electric current flows to generate heat due to Joule heating.

More specifically, the resistive heat layer 156 is a 40 μm thick layer formed, for example, by coating a solvent prepared by dispersing, in a polyimide resin used as a base material, one or more conductive fillers mutually different in electrical resistance.

The resistive heat layer 156 is 320 mm long in the Y-axis direction.

Although heat-resistant insulating resins, such as PPS and PEEK, other than PI may be usable as the base material for forming the resistive heat layer 156, PI is preferable as it has the highest heat resistance.

Preferable examples of the conductive fillers include: metals, such as Ag, Cu, Al, Mg and Ni; carbon-based powder materials, such as carbon nanotube and carbon nanofiber; and high-ion conductive powder materials, such as silver iodide and copper iodide, present in inorganic compounds.

Preferably, the electrically conductive fillers are in a fibrous state to ensure that the conductive fillers to make more contact per unit content and the base material permeates into the conductive fillers more easily.

Among the above-mentioned constituents of conductive fillers, each metal has a positive temperature coefficient (PTC) so that the volume resistance of the metal increases with an increase in temperature. On the other hand, each carbon-based powder material and high-ion conductive powder material has a negative temperature coefficient (NTC) so that the volume resistance of the powder decreases with a decrease in temperature. By mixing those constituents having opposite properties at an appropriate ratio, the resulting fillers exhibit a desired volume resistance.

Note that the base material may additionally include a filler other than those mentioned above, in order to improve the mechanical strength and/or thermal conductivity of the resistive heat layer 156.

On condition that the power supply 180 is a commercial power supply as mentioned above, the volume resistance preferably falls within the range from $1.0\times10^{-6}$ to $1.0\times10^{-2}$ Ω·m in order to achieve an intended heating value. More preferably, in view of the configuration of the fixing unit 5 according to the present embodiment, the volume resistance preferably falls within the range from $1.0\times10^{-5}$ to $5.0\times10^{-3}$ Ω·m.

The electrode layers 159*a* and 159*b* are spaced apart in the Y-axis direction, so that an area of the fixing belt 154 within which a recording sheet S will pass (hereinafter, "sheet passing area") is flanked by the electrode layers 159*a* and 159*b*. In addition, the electrode layers 159*a* and 159*b* are in contact with a corresponding one of the power feeders 170 to supply power to the resistive heat layer 156.

As described above, the electrode layers 159*a* and 159*b* are disposed in flanking relation along opposite edges of the resistive heat layer 156. More specifically, one end face of the electrode layer 159*a* is connected to the end face of the resistive heat layer 156 facing toward the Y'-axis direction, whereas one end face of the electrode layer 159*b* is connected to the end face of the resistive heat layer 156 facing toward the Y-axis direction.

That is, as shown in FIG. 4, the resistive heat layer 156 and the electrode layers 159*a* and 159*b* all disposed on the reinforcing layer 155 are linearly aligned when seen in a cross section taken along a plane perpendicular to the direction in which the fixing belt 154 runs (direction indicated by the arrow E).

Note that the end faces 156*c* and 156*d* of the resistive heat layer 156 each in contact with one of the electrode layers 159*a* and 159*b* are perpendicular to the direction in which electric current flows (perpendicular to the Y-axis direction).

With this configuration, a portion of the resistive heat layer 156 residing between the end faces 156*c* and 156*d* constitutes the shortest path of electric current flow. For this reason, electric current flows into the resistive heat layer 156 through one of the end faces 156*c* and 156*d* and flows out of the resistive heat layer 156 thorough the other one of the end faces 156*c* and 156*d*.

As described above, the end faces 156*c* and 156*d* are the portions of the resistive heat layer 156 through which electric current to and from the electrode layers 159*a* and 159*b* flows. That is, the cross sectional area of the path of electric current flow is larger as compared with a conventional technique according to which current flows only through where line contact is made between the surface of the resistive heat layer and the edge portion of the electrode layer closer toward the sheet passing area. As a result, the above configuration of the present embodiment prevents a local increase of the current density.

The electrode layers 159*a* and 159*b* are made, for example, from a material with low electrical resistance, such as Cu, Ni, Ag, Al, Au, Mg, brass, phosphor bronze, or an alloy of the metals mentioned above. The electrode layers 159*a* and 159*b* are formed by plating, with the material, the outer circumferential surface of the reinforcing layer 155 along the respective edges. Alternatively, a conductive ink in which one or more of the above mentioned metals are dispersed may be applied to the outer circumferential surface of the reinforcing layer 155 along the respective edges, followed by drying.

Preferably, each of the electrode layers 159*a* and 159*b* is 15 mm long in the Y-axis direction and in the range from 1 μm to 100 μm in thickness. In this example, the thickness is 20 μm.

Note that the electrode layers 159*a* and 159*b* are formed on the reinforcing layer 155 after the resistive heat layer 156 is formed.

In the manufacturing process, the resistive heat layer 156 is formed such that one of the end faces in width direction, namely end face 156*c*, is in contact with one end face of the electrode layer 159*a* and that the other end face 156*c* is in contact with one end face of the electrode layer 159*b*.

The volume resistivity of the electrode layers 159*a* and 159*b* is set to be equal to that of the resistive heat layer 156 or less, and preferably falls within the range of $1.0\times10^{-8}$ Ω·m to $1.0\times10^{-4}$ Ω·m.

Note that the difference between the volume resistivity of the electrode layers 159*a* and 159*b* with the volume resistivity of the resistive heat layer 156 may be relatively small. Even so, by configuring the electrode layers 159*a* and 159*b* to be relatively thicker and the resistive heat layer 156 to be relatively thinner, the electrode layers 159*a* and 159*b* are sufficiently usable as electrodes and the resistive heat layer 156 as a heat generating element.

Note, in addition, that the electrode layers 159*a* and 159*b* should not be too thin in order to avoid a voltage drop that would occur before the current injected into the electrode layers 159*a* and 159*b* through portions in contact with the power feeders 170 reaches locations halfway around the outer circumference.

As a result, the electric current in the resistive heat layer 156 would flow only through and near a path defined by connecting the two contact portions located in the edge portions of the fixing belt 154, which ends up narrowing the heat generating area.

The minimum allowable thickness of each of the electrode layers 159*a* and 159*b* is determined in order to avoid undesirable situations described above.

The elastic layer 157 is made from, for example, an elastic and heat-resisting material such as silicone rubber and about 200 μm thick.

Alternatively to the silicone rubber, the elastic layer 157 may be made from, for example, a fluorine-containing rubber.

The releasing layer 158 is made from a material having releasability, typified by a fluorine-containing resin, such as PTFE or PFA, and its thickness is in the range from 5 μm to 100 μm.

<Confirmation of Improved Temperature Distribution>

Unlike a conventional fixing device having a resistive heat layer of a uniform thickness and a pair of electrode layers simply laminated on the respective edge portions of the resistive heat layer, the fixing device according to this embodiment has the following characteristics. That is, in the cross section shown in FIG. 4 that is taken along a plane perpendicular to the running direction of the fixing belt 154, the resistive heat layer 156 and the electrode layers 159*a* and 159*b* are in liner alignment. In addition, the resistive heat layer 156 is in end-to-end contact with the electrode layers 159*a* and 159*b*.

Figure 5A:
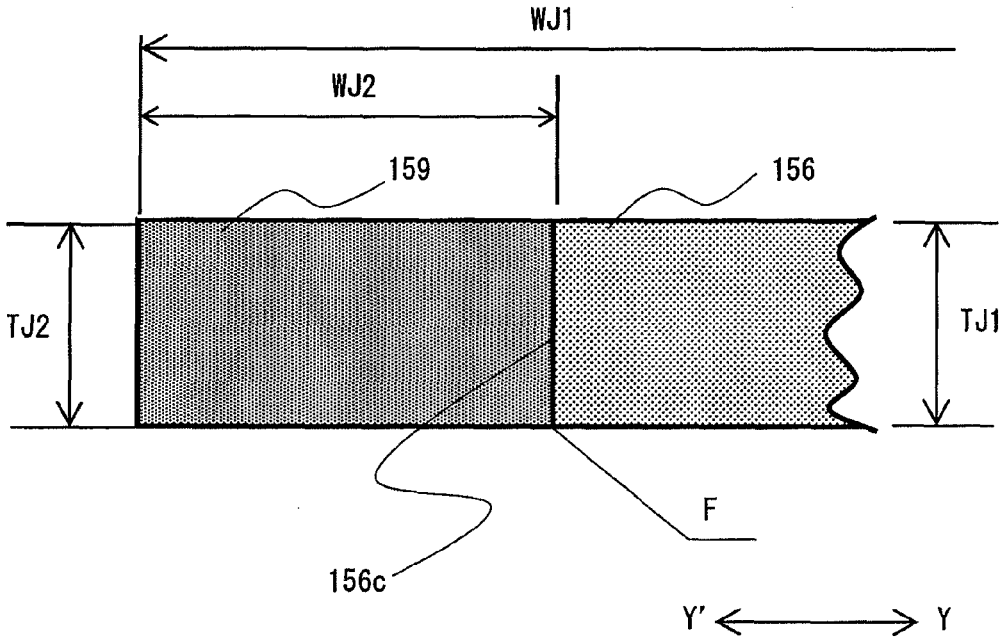
FIGS. 5A and 5B are views illustrating the temperature reduction achieved at overheating portions of a fixing belt according to the embodiment of the present invention.

FIG. 5A is a view of an edge portion (Y'-axis edge portion) of the fixing belt 154 as described above, to show a simulated temperature distribution across the electrode layer 159*a* and the resistive heat layer 156.

Figure 5B:
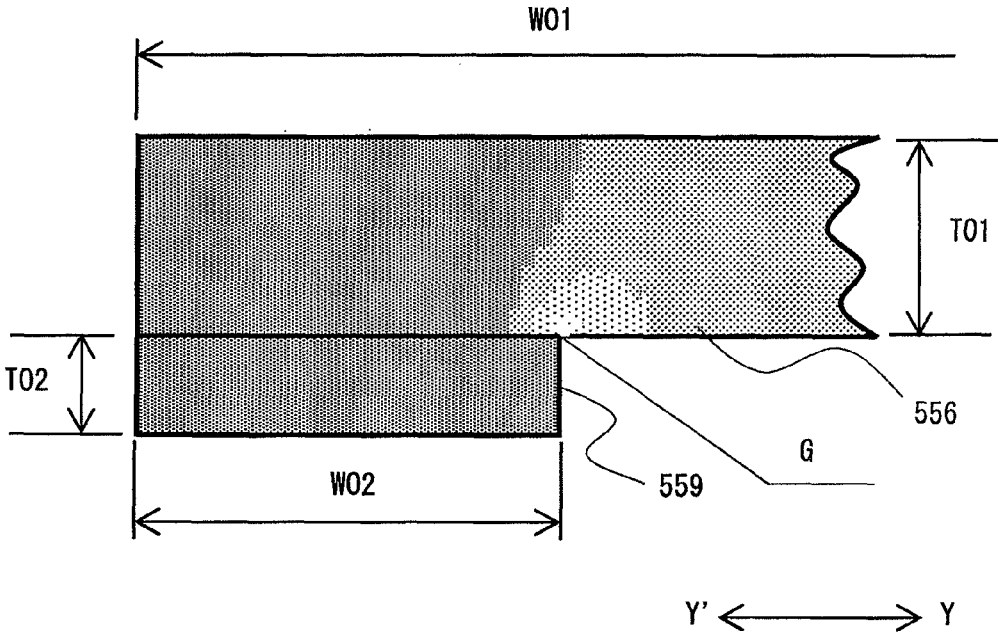

FIG. 5B is a view of an Y'-axis edge portion of the conventional fixing belt 500, to show a simulated temperature distribution across the electrode layer 559 and the resistive heat layer 556.

In the simulation, a model containing only the electrode layer 159*a* and the resistive heat layer 156 is used.

In the figure, darker colors represent lower temperatures, whereas lighter colors represent higher temperatures.

<Simulation Conditions>

Volume resistivity of resistive heat layer: $9.4\times10^{-5}$ Ω·m

Applied voltage: 100 V

Volume resistivity of electrode: $1.72\times10^{-8}$ Ω·m

The simulation conditions other than those mentioned above are the same as the fixing belt 154 according to the present embodiment.

<Dimensions>

The dimensions of the portions denoted by the following reference signs in FIGS. 5A and 5B are as follows.

PRESENT EMBODIMENT

WJ1: 340 mm (width in Y-axis direction)

WJ2: 15 mm

TJ1: 40 μm

TJ2: 40 μm

Conventional Product

WO1: 340 mm (width in Y-axis direction)

WO2: 15 mm

TO1: 40 μm

TO2: 20 μm

As shown in FIG. 5B relating to the conventional product, the temperature of the resistive heat layer 556 is highest along where a ring contact is made with the annular edge G of the electrode layer 559 closer toward the center of the fixing belt.

In contrast, as shown in FIG. 5A relating to the present embodiment, the temperature is uniform across the electrode layer 159*a* and the resistive heat layer 156, which means that the boundary portion F (the end face 156*c*) is included. In addition, the temperature is lower as compared with the conventional product.

The following is assumed to be the reason for this phenomenon.

That is, in the conventional product, the current flows from the electrode layer 559 to the resistive heat layer 556 mainly through where the annular edge G of the electrode layer 559 contacts the resistive heat layer 556, which leads to increase the current density and thus increase the temperature at the annular edge G of the electrode layer 559.

It is because electric current tends to flow along paths of least electrical resistance. Regarding the current flowing between the electrode layer 559 and the resistive heat layer 556, the electrical resistance is smaller in a path through the annular edge G of the electrode layer 559 than through the portion where the electrode layer 559 makes surface contact with the resistive heat layer 556 (i.e., without passing through the annular edge G). Therefore, despite the surface contact between the electrode layer 559 and the resistive heat layer 556, the current flow between the electrode layer 559 and the resistive heat layer 556 takes place mostly through the annular edge G.

In contrast, the fixing belt 154 according to the present embodiment, the resistive heat layer 156 and the electrode layers 159*a* and 159*b* are in linear alignment when seen in a cross section taken along a plane perpendicular to the running direction of the fixing belt 154 runs. That is, the resistive heat layer 156 is in end-to-end contact at the end face 156*c* with the electrode layer 159*a* and also at the end face 156*d* with the electrode layer 159*b*.

With this configuration, part of the resistive heat layer 156 residing between the end faces 156*c* and 156*d* constitutes the shortest path of electric current flow.

That is, the cross sectional area of the path of electric current flow is larger as compared with a conventional technique according to which current flows only through where line contact is made between the surface of the resistive heat layer and one of the edge portions of each electrode layer closer toward the sheet passing area. As a result, the above configuration of the present embodiment prevents local increase of the current density.

As a result, local heating is prevented as much as possible, which is effective to extend the life of the fixing belt 154.

Figure 6:
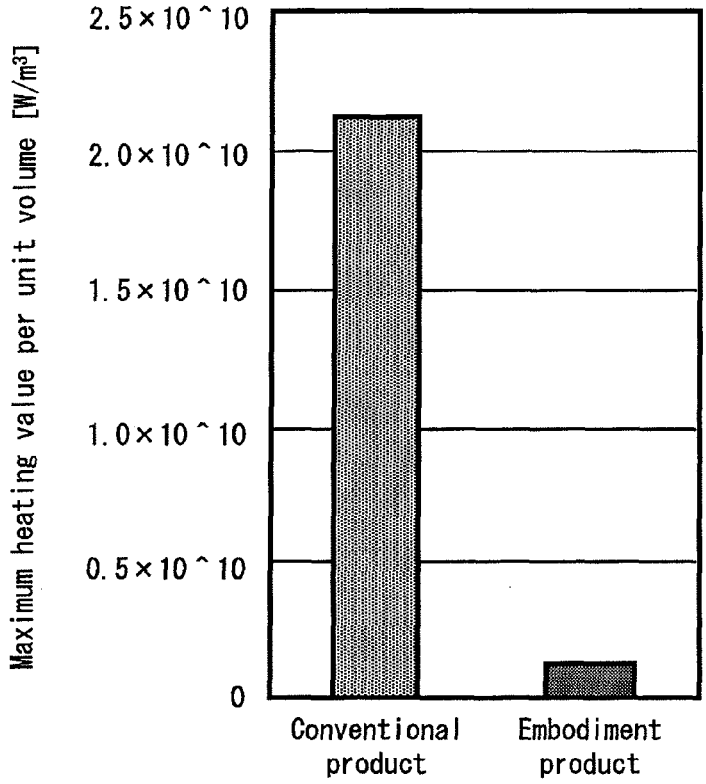
FIG. 6 is a graph of the temperature reduction achieved at overheating portions of the fixing belt according to the embodiment of the present invention.

FIG. 6 is a graph of the simulated maximum heating values per unit volume of the respective resistive heat layers according to the conventional product and the present embodiment.

As shown in the figure, the maximum heating value per unit volume exhibited by the product of the present embodiment is only about 1/21 of the conventional product.

Figure 7:
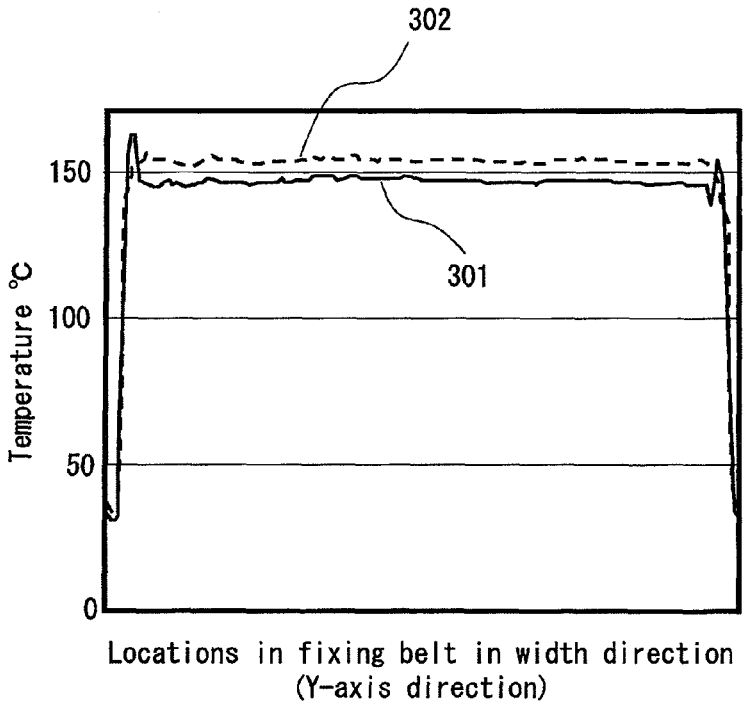
FIG. 7 is a graph of the temperature distribution across the width of the fixing belt according to the embodiment of the present invention.

FIG. 7 is a graph showing temperature distributions along the Y-axis direction, simulated for the conventional fixing belt 500 mentioned above and the fixing belt 154.

In the graph, the horizontal axis represents locations along the width direction (Y-axis direction) of the fixing belt, whereas the vertical axis represents temperatures of the fixing belt.

In addition, the reference sing "301" denotes a conventional product and "302" denotes a product of the present embodiment (hereinafter, "embodiment product").

As shown in the figure, the conventional product 301 exhibits a temperature rise to about 164° C. at portions near the edges in the Y-axis direction and to the range ambient to 148° C. at portions between the edge portions.

That is, in the conventional product 301, the temperatures differ as much as 16° C. when the edge portions are compared with the portions between the edge portions.

In contrast, the embodiment product 302 shows temperatures maintained within the range of 151° C. to 154° C. throughout the fixing belt, including portions near the edges in the Y-axis direction and portions between the edge portions.

As apparent from the above, the embodiment product 302 is smaller in variations in temperatures at various locations within the fixing belt, as compared with the conventional product 301.

Normally, the fusing temperature is set to fall within the range ambient to 160° C., and the heat-resistant temperature required for the fixing belt 154 is up to 240° C.

Therefore, it is required that the highest temperature measured at any location within the fixing belt 154 be 240° C. or lower.

In addition, the life of the fixing belt 154 is expected to be shorter at portions where temperatures are higher. Then, there is a risk of cracks running from a location having reached the end of its useful life.

In order to prevent such undesirable situations, it is required that the temperatures be uniform throughout the fixing belt 154, i.e., the temperature at any portion of the fixing belt 154 be not locally high.

The fixing belt 154 according to the present embodiment is configured such that the highest temperature measured at any location within the fixing belt 154 is 240° C. or lower, while the overall temperature of the fixing belt 154 is lower and more uniform than a conventional fixing belt. Therefore, the present embodiment extends the life of the fixing belt and prevents or at least reduces thermal deformation.

<Modifications>

The present invention is not limited to the specific embodiment described above and various modifications including the following may be made.

(1) According to the embodiment described above, the fixing belt 154 includes the reinforcing layer 155, the resistive heat layer 156, the elastic layer 157, the releasing layer 158, and the electrode layers 159*a* and 159*b*. However, this description is given merely by way of example and without limitation. It is sufficient that the fixing belt at least includes the resistive heat layer 156 and the electrode layers 159*a* and 159*b*.

For example, in the case of a monochrome copier, the fixing nip may be smaller in width without adversely affecting the fixing quality much, as compared with the case of a color copier. For this reason, the fixing belt 154 for a monochrome copier may be configured without the elastic layer 157.

(2) According to the above embodiment, the resistive heat layer 156 is described to be formed before the electrode layers 159*a* and 159*b* are formed. However, the description is given merely by way of example and without limitation.

More specifically, the electrode layers 159*a* and 159*b* may be formed before the resistive heat layer 156 is formed.

In such a case, in the process of forming the resistive heat layer 156, it is preferable to connect the resistive heat layer 156 at one end face to an end face of the electrode layer 159*a* and at another end face to an end face of the electrode layer 159*b*.

(3) In addition, in the fixing belt 154 according to the present embodiment, the resistive heat layer 156 and the electrode layers 159*a* and 159*b* are linearly aligned when seen in a cross section taken along a plane perpendicular to the running direction of the fixing belt 154. However, the description is given merely by way of example and without limitation.

In a modification 1 shown in FIG. 8, an electrode layer 259 is composed of a straight portion 259*a* and a bend portion 259*b* to together define an L-shape in cross section. The bend portion 259*b* is disposed in contact with the end face 156*c* of the resistive heat layer 156. In addition, an insulating layer 153 is disposed between the resistive heat layer 156 and the straight portion 259*a* of the electrode layer 259.

With this modification, the electrode layer 259 is in contact with the resistive heat layer 156 only at the end face 156*c*, so that the current flow between the electrode layer 259 and the resistive heat layer 156 is similar to that between the electrode layer 159*a* and the resistive heat layer 156 according to the embodiment described above. Accordingly, the fixing belt 154 is configured not to cause local overheating and thus is expected to have a long life.

Note that although FIG. 8 shows the configuration of only one of the edge portions of the resistive heat layer 156 (i.e., edge closer toward Y'-axis direction), it is preferable that the other edge portion of the resistive heat layer 156 (i.e., edge closer toward Y-axis direction) has the same configuration.

In a modification 2 shown in FIG. 9, an electrode layer 359 is composed of a pair of leg portions having opposing faces 359*a* and 359*b* and a bottom portion 359*c* connecting the leg portions to together define a squared U shape. The bottom portion 359*c* is disposed in contact with the end face 156*c* of the resistive heat layer 156. In addition, an insulating layer 153 is disposed on the opposing face 359*a* of one of the leg portions (i.e., between the leg portion and the resistive heat layer 156), and an reinforcing layer 155 is disposed on the opposing face 359*b* of the other one of the leg portions (i.e., between the leg portion and the resistive heat layer 156).

That is, the electrode layer 359 is continuous to extend along part of the inner circumferential surface (i.e., the radially inward surface), the end face, and part of the outer circumferential surface (i.e., the radially outward surface) of the resistive heat layer 156. In addition, one insulating layer 153 is disposed between the electrode layer 359 and the inner circumferential surface of the resistive heat layer 156 and another insulating layer 153 is disposed between the electrode layer 359 and the outer circumferential surface of the resistive heat layer 156.

With this modification, the electrode layer 359 makes contact with the resistive heat layer 156 only at the end face 156*c*, so that the current flow between the electrode layer 359 and the resistive heat layer 156 is similar to that between the electrode layer 159*a* and the resistive heat layer 156 according to the embodiment described above. Accordingly, the fixing belt 154 is configured not to cause local overheating and thus is expected to have a long life.

As shown in FIG. 9, the electrode layer 359 defines a squared U-shape in cross section, and therefore both the inner and outer circumferential surfaces are exposed. This allows the power feeder 170 to be placed in contact with the circumferential surfaces to feed electric power.

Note that although FIG. 9 shows the configuration of only one of the edges of the resistive heat layer 156 (i.e., edge closer toward Y'-axis direction), it is preferable that the other edge of the resistive heat layer 156 (i.e., edge closer toward Y-axis direction) has the same configuration.

(4) In the above embodiment, the electrode layers 159*a* and 159*b* are in contact with the resistive heat layer 156 only at the end faces 156*c* and 156*d*. Yet, it is applicable that the electrode layers 159*a* and 159*b* makes contact with the resistive heat layer 156 also at areas of the circumferential surface near the end faces 156*c* and 156*d*.

FIG. 10 is a view showing a modification 3 having the configuration as described above.

Since a fixing belt shown in FIG. 10 is similar to the fixing belt shown in FIG. 8, the following describes the difference only.

The fixing belt shown in FIG. 8 has the insulating layer 153 between the straight portion 259*a* of the electrode layer 259 and the outer circumferential surface of the resistive heat layer 156. However, the fixing belt shown in FIG. 10 does not have anything that corresponds to the insulating layer 153. Furthermore, an electrode layer 459 has a straight portion 459*a* which corresponds to the straight portion 259 but is shorter in length in the Y-axis direction (hereinafter referred to as "length WJ3").

With this modified configuration, local overheating of the fixing belt is alleviated to some extent for the following reason.

FIG. 11 is a graph showing the simulated maximum heating values per unit volume of the resistive heat layer 156 with a different length WJ3 (the length of the electrode layer in the Y-axis direction).

A portion 156*e* of the resistive heat layer 156 that exhibits the maximum heating values unit volume is where line contact is made between the circumferential surface of the resistive heat layer and the edge of the electrode layer 459.

As shown in FIG. 11, the maximum heating values per unit volume decreases with a decrease in length WJ3. Especially, with the length WJ3 being 2 mm or shorter, the maximum heating values per unit volume tend to drop sharply.

For example, with the length WJ3 of 1 mm, the electrode exhibits the maximum heating value per unit volume of $1.5\times10^{10}$ [W/m$^3$], which is about 70% of a conventional electrode.

This is ascribable to the following fact. That is, with a decrease in the length WJ3, the portion of the resistive heat layer 156 that is in contact with the electrode layer 459 in the Y-axis direction decreases in length in the Y-axis direction.

Therefore, irrespective of difference in the location in the electrode layer 459 in the Y-axis direction though which current flows from the resistive heat layer 156, the resistance of the resulting current path remains about the same. Consequently, the current flow into the resistive heat layer 156 is ensured to be distributed to some extent.

As described above, although the electrode layer 459 is in contact with the resistive heat layer 156 at a portion other than the end face 156*c* (or end face 156*d*), as long as the contact portion is within the range of 2 mm from the end face 156*c* (or end face 156*d*), the advantageous effect is achieved that the maximum heating value per unit volume is lower than a conventional configuration.

Further, in the case were the length WJ3 is extremely short, it is preferable to use power feeders 270 of smaller size accordingly.

In a modification 4, an electrode layer 465 as shown in FIG. 12 may be used alternatively to the electrode layer 459 defining an L-shaped cross section. The electrode layer 465 is composed of a pair of leg portions having opposing faces 465*a* and 465*b* and a bottom portion 465*c* connecting the leg portions together define a squared U shape. The opposing surfaces 465*a* and 465*b* as well as the bottom portion 465*c* of electrode layer 465 are in contact with end face 156*c* (or end face 156*d*) and its nearby portion of the resistive heat layer 156.

In this modification, a portion of the electrode layer 465 makes contact with the inner and outer circumferential surfaces of the resistive heat layer 156. It is preferable that the length WJ4 of the contact portion of the electrode layer 465 is relatively short in the Y-axis direction.

In this modification, however, the current from the electrode flows into the resistive heat layer 156 through two contact portions, one on the inner circumferential surface and the other on the outer circumferential surface. As a result, localization of the current occurs at two locations rather than a single location, which is expected to lead to a 50 percent reduction of the maximum heating value per unit volume (i.e., the Y-axis value) shown in FIG. 11.

Owing to the above, even with the length WJ4 is about 15 mm, which is comparable to a conventional configuration, the modification 4 reduces the risk of localized current flow as compared to a conventional product.

As above, the electrode layer 465 defining a squared U shape in cross section is provided at an end of the resistive heat layer 156, and the fixing belt 154 is configured to be wider than the pressure roller 150. Then, each power feeder 270 may be disposed to be in contact with both the outer and inner circumferential surfaces of the electrode layer 465.

With a configuration that each power feeder 270 makes contact with a limited area of the electrode layer 465, it is preferable that the contact is made with both the outer and inner circumferential surfaces of the electrode layer 465, so that the power feeder 270 is reliably placed in a power feed state.

The configuration shown in FIG. 12 may be further modified to include an insulating layer between either of the inner and outer circumferential surfaces of the resistive heat layer 156 and the electrode layer 465.

That is, the electrode layer may be continuous to extend along part of the inner circumferential surface, the end face, and part of the outer circumferential surface of the resistive heat layer 156 and in contact with at least either of the inner and outer circumferential surfaces of the resistive heat layer 156.

Yet, the following should be noted regarding the configuration in which each electrode layer is in contact with only either of the inner and outer circumferential surfaces of the resistive heat layer 156. That is, the same description of the current density given in relation to the configuration shown in FIG. 10 applies to this configuration. Consequently, it is also preferable that the contact portion between the electrode layer and the resistive heat layer is within the range of 2 mm from the end face of the resistive heat layer.

Alternatively and as shown in FIG. 12, each electrode layer may be in contact with both the inner and outer circumferential surfaces of the resistive heat layer 156. In this configuration, the current density reaches its maxim at two separate locations, so that the maximum current density is lower than otherwise it would be, Therefore, by ensuring that the contact portion between the electrode layer and the resistive heat layer falls within the range of 2 mm or so from the end face 156*c* of the resistive heat layer 156, heat generation is sufficiently reduced.

(5) In the above embodiment, the pressure roller 150 is disposed inside the running path of the fixing belt 154 with play relatively to the fixing belt 154. Alternatively, however, the pressure roller 150 may be disposed without play.

In addition, a fixing roller may be employed in which the pressure roller 150 and the fixing belt 154 are integrated.

More specifically, the outer circumferential surface of the roller shaft may be covered with a roller cover made with a laminate of an elastic layer, a resistive heat layer, an electrode layer, a releasing layer, and so on.

Alternatively, the fixing belt 154 may be wound around first and second rollers in taut condition.

In this modification, the first roller may be a pressure roller that cooperates with the pressing roller to form a fixing nip, whereas the second roller may be a roller for setting the length of the fixing belt 154.

With the above configuration, a reduction in outer diameter of the pressure roller improves the releasability of recording sheets. In addition, an increase in the length of the fixing belt 154 reduces the number of rotation per unit time, which leads to the reduction of friction and thus to a longer life of the fixing belt 154.

(6) In the above embodiment, each power feeder 170 is provided with the brush 171 having the shape of a block that slides over the electrode layer 159*a* or 159*b* of the fixing belt 154. Alternatively, however, each power feeder 170 may be provided with a metal roller instead of the brush 171 to keep electric contact with the electrode layer 159*a* or 159*b*, while reducing the friction with the electrode layer.

In a modification 5 shown in FIG. 13, a primary coil 271 connected to the power supply 180 is disposed on the main body of the fixing device, whereas a secondary coil 272 is wound around an edge of the fixing belt 254. The secondary coil 272 is connected at one end 272*a* to the electrode layer 159*a*, and to the electrode layer 159*b* at another end 272*b*. An AC current is supplied to the primary coil 271 being opposed to the secondary coil 272, so that an electric current is induced in the secondary coil to supply electric power to the electrode layers 159*a* and 159*b* in a non-contact manner.

(7) According to the above embodiment, a material having PTC and a material having NTC are mixed at an appropriate ratio to obtain conducive fillers to exhibit a desired volume resistance. In addition, the ratio may be adjusted for any other purpose.

For example, consider the case where a number of small-size recording sheets are successively printed. In this case, the temperature of the fixing belt 154 tends to be higher at the edge portions where no recording sheets pass (sheet non-passing areas) because no heat is transferred to such recording sheets. In view of this, a fixing belt may be configured with conductive fillers having high content NTC content at the edge portions, so that the temperature rise at sheet non-passing areas is reduced.

Generally, the sheet non-passing areas are located in contact with or near an electrode layer. Therefore, the current density locally increases at portions near the boundary between the electrode layer and the resistive heat layer to raise the temperature. Consequently, the volume resistivity decreases, which leads to an effect of reducing the heating.

The fixing belt 154 according to the above embodiment is configured not to cause an increase in current density at the boundary portions. Therefore, the heating at the boundary portions are duly suppressed, without requiring that the sheet non-passing areas be high in content of conductive filler with a high NTC content.

(8) According to the present embodiment, the electrode layers 159*a* and 159*b* are each in an annular form that surrounds the fixing belt 154 in a circumferential direction. However, this description is given merely by way of example and without limitation. For example, each of the electrode layers 159*a* and 159*b* may have at least one slit non-orthogonal or in parallel to the axis of the pressure roller 150.

In this modification, the locations of the power feeder 170 or the number of slits provided may be optimized to heat only part of the fixing belt 154 relevant to the formation of the fixing nip N, which leads to power savings.

(9) In the above embodiment, the electrode layers 159*a* and 159*b* are disposed outside the running path of the fixing belt 154. Alternatively, however, the electrode layers 159*a* and 159*b* may be disposed inside the running path of the fixing belt 154.

In this modification, it is naturally appreciated that each power feeder 170 needs to be disposed inside the running path of the fixing belt 154 to be in contact with a corresponding one of the electrode layers 159*a* and 159*b*.

In addition, it is preferable that the relation between the pressure roller 150 and the pressing roller 160 are reversed in terms of axial lengths, so that the power feeders 170 press the electrode layers 159*a* and 159*b* against the outer circumferential surface of the pressing roller 160.

(10) In the above embodiment, the power feeders 170 are disposed at locations that would meet the fixing nip N if extended in the axial direction. This disposition is to avoid the fixing belt 154 from being displaced backward when the feeders 170 come to press the electrode layers 159*a* and 159*b*.

In one modification, one or more regulating plates may be provided inside the running path of the fixing belt 154 to retain the running path of the fixing belt 154. Then, each power feeder 170 is disposed outside the running path of the fixing belt 154 at a location opposite the regulating plate. With this configuration, the fixing belt 154 is kept on the running path without being retracted, backward, even when the power feeders 170 are pressed against the electrode layers 159*a* and 159*b*. Consequently, the electrodes are reliably maintained in contact with the fixing belt 154.

(11) According to the above embodiment, the components, namely the pressure roller 150 and the pressing roller 160, that are disposed to sandwich the fixing belt 154 to form a fixing nip are both rotatable bodies. Alternatively, however, only one of the components may be a rotatable body and the other component may be a non-rotatable, fixed body as long as the other component cooperates with the rotatable body to apply pressure to the fixing belt 154.

One example of such a member is a member of long dimension in a direction perpendicular to the running direction of the fixing belt 154 having a highly smooth surface.

In short, any member, such as a rotatable body or a fixed member of long dimension, is usable as long as the member is usable to apply pressure.

(12) In the above embodiment, both the end faces 156*c* and 156*d* of the resistive heat layer 156 are perpendicular to the Y-axis direction, i.e., the direction of the current flow. However, this description is given merely by way of example and without limitation. The end face 156*c* and 156*d* may not be perpendicular to the Y-axis direction.

Yet, with the inclination of the end faces 156*c* and 156*d* away from the perpendicular state, the difference between the shortest and longest lengths of the resistive heat layer increases in the Y-axis direction. Therefore, it is preferable that the end faces 156*c* and 156*d* are perpendicular to the Y-axis direction.

(13) The above embodiment is directed to an example in which the image forming apparatus according to the present invention is applied to a tandem-type digital color printer. However, this description is given merely by way of example and without limitation. The present invention is generally applicable to a fixing device having a pressure member, such as a pressure roller, disposed inside the running path of the fixing belt and a pressing roller pressing the pressure member via the fixing belt, whereby a fixing nip is formed. The present invention is also applicable generally to an image forming apparatus having such a fixing device.

In addition, any combination of the above embodiment and modifications still falls within the scope of the present invention.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

What is claimed is:

1. A fixing device for thermally fixing an unfixed image formed on a recording sheet by passing the recording sheet through a fixing nip, the fixing device comprising:

a heat-generating endless belt having, on a circumferential surface thereof, a sheet passing area through which the recording sheet passes;

a first pressure member disposed inside a running path of the heat-generating endless belt; and a second pressure member disposed to press the heat-generating endless belt against the first pressure member from outside the running path to form the fixing nip, wherein the heat-generating endless belt includes:

a resistive heat layer that generates heat upon having electric current applied thereto; and a pair of electrode layers that receive electric current, the electrode layers flanking the sheet passing area, and the resistive heat layer is in contact with the electrode layers at a different one of end faces opposing each other in a width direction of the resistive heat layer, wherein each electrode layer is continuous to extend, from a portion thereof in contact with the end face of the resistive heat layer, along an inner circumferential surface and an outer circumferential surface of the resistive heat layer, and the heat-generating endless belt includes insulating layers, one between the electrode layer and the inner circumferential surface of the resistive heat layer and, another between the electrode and the outer circumferential surface of the resistive heat layer.

2. The fixing device according to claim 1, wherein the first pressure member is a cylindrical pressure roller, the heat-generating endless belt is fit with clearance about the first pressure member, and the first pressure member and the heat-generating endless belt rotate following rotation of the second pressure member.

3. The fixing device according to claim 1, wherein the first pressure member is a cylindrical roller shaft, the heat-generating endless belt is a roller cover disposed on an outer circumferential surface of the roller shaft, and the roller shaft and the roller cover together comprises a single roller.

4. The fixing device according to claim 1, wherein the resistive heat layer is made of a heat-resistant insulating resin containing a conductive filler dispersed therein.

5. A fixing device for thermally fixing an unfixed image formed on a recording sheet by passing the recording sheet through a fixing nip, the fixing device comprising:

a heat-generating endless belt having, on a circumferential surface thereof, a sheet passing area through the recording sheet passes;

a first pressure member disposed inside a running path of the heat-generating endless belt; and a second pressure member disposed to press the heat-generating endless belt against the first pressure member from outside the running path to form the fixing nip, wherein the heat-generating endless belt includes:

a resistive heat layer that generates heat upon having electric current applied thereto; and a pair of electrode layers that receive electric current, the electrode layers flanking the sheet passing area, and the resistive heat layer is in contact with the electrode layers at a different one of end faces opposing each other in a width direction of the resistive heat layer, wherein each electrode layer is continuous to extend, from a portion thereof in contact with the end face of the resistive heat layer, along one of an inner circumferential surface and an outer circumferential surface of the resistive heat layer, and is in contact with the one of the inner and outer circumferential surfaces of the resistive heat layer, and a portion of the one of the inner and outer circumferential surfaces of the resistive heat layer that is in contact with each electrode layer is 2 mm or shorter from the end face of the resistive heat layer.

6. The fixing device according to claim 5, wherein each electrode layer is continuous to extend, from the portion thereof in contact with the end face of the resistive heat layer, along the inner circumferential surface and the outer circumferential surface of the resistive heat layer, and is in contact with both the inner and outer circumferential surfaces of the resistive heat layer.

7. An image forming apparatus including a fixing device for thermally fixing an unfixed image formed on a recording sheet by passing the recording sheet through a fixing nip, the fixing device comprising:

a heat-generating endless belt having, on a circumferential surface thereof, a sheet passing area through which the recording sheet passes;

a first pressure member disposed inside a running path of the heat-generating endless belt; and a second pressure member disposed to press the heat-generating endless belt against the first pressure member from outside the running path to form the fixing nip, wherein the heat-generating endless belt includes:

a resistive heat layer that generates heat upon having electric current applied thereto; and a pair of electrode layers that receive electric current, the electrode layers flanking the sheet passing area, and the resistive heat layer is in contact with the electrode layers at a different one of end faces opposing each other in a width direction of the resistive heat layer, wherein each electrode layer is continuous to extend, from a portion thereof in contact with the end face of the resistive heat layer, along an inner circumferential surface and an outer circumferential surface of the resistive heat layer, and the heat-generating endless belt includes insulating layers, one between the electrode layer and the inner circumferential surface of the resistive heat layer and, another between the electrode and the outer circumferential surface of the resistive heat layer.

8. The image forming apparatus according to claim 7, wherein the first pressure member is a cylindrical pressure roller, the heat-generating endless belt is fit with clearance about the first pressure member, and the first pressure member and the heat-generating endless belt rotate following rotation of the second pressure member.

9. The image forming apparatus according to claim 7, wherein the first pressure member is a cylindrical roller shaft, the heat-generating endless belt is a roller cover disposed on an outer circumferential surface of the roller shaft, and the roller shaft and the roller cover together comprises a single roller.

10. The image forming apparatus according to claim 7, wherein the resistive heat layer is made of a heat-resistant insulating resin containing a conductive filler dispersed therein.

11. An image forming apparatus including a fixing device for thermally fixing an unfixed image formed on a recording sheet by passing the recording sheet through a fixing nip, the fixing device comprising:

a heat-generating endless belt having, on a circumferential surface thereof, a sheet passing area through which the recording sheet passes;

a first pressure member disposed inside a running path of the heat-generating endless belt; and a second pressure member disposed to press the heat-generating endless belt against the first pressure member from outside the running path to form the fixing nip, wherein the heat-generating endless belt includes:

a resistive heat layer that generates heat upon having electric current applied thereto; and a pair of electrode layers that receive electric current, the electrode layers flanking the sheet passing area, and the resistive heat layer is in contact with the electrode layers at a different one of end faces opposing each other in a width direction of the resistive heat layer, wherein each electrode layer is continuous to extend, from a portion thereof in contact with the end face of the resistive heat layer, along one of an inner circumferential surface and an outer circumferential surface of the resistive heat layer, and is in contact with the one of the inner and outer circumferential surfaces of the resistive heat layer, and a portion of the one of the inner and outer circumferential surfaces of the resistive heat layer that is in contact with each electrode layer is 2 mm or shorter from the end face of the resistive heat layer.

12. The image forming apparatus according to claim 11, wherein each electrode layer is continuous to extend, from the portion thereof in contact with the end face of the resistive heat layer, along the inner circumferential surface and the outer circumferential surface of the resistive heat layer, and is in contact with both the inner and outer circumferential surfaces of the resistive heat layer.

* * * * *